US007428897B2

(12) United States Patent
Köster et al.

(10) Patent No.: US 7,428,897 B2
(45) Date of Patent: Sep. 30, 2008

(54) CONTROLLABLE TWO WAY VALVE DEVICE

(75) Inventors: Andreas Köster, Essen (DE); Heinrich Dismon, Gangelt (DE); Hans-Jürgen Hüsges, Willich (DE); Hans-Ulrich Kühnel, Mönchengladbach (DE); Franz Dellen, Willich (DE); Ridel Röttges, Tönisvorst (DE)

(73) Assignee: Pierburg GmbH, Neuss (DE)

( * ) Notice: Subject to any disclaimer, the term of this patent is extended or adjusted under 35 U.S.C. 154(b) by 0 days.

(21) Appl. No.: 10/599,280

(22) PCT Filed: Apr. 12, 2005

(86) PCT No.: PCT/EP2005/003802

§ 371 (c)(1),
(2), (4) Date: Sep. 25, 2006

(87) PCT Pub. No.: WO2005/113972

PCT Pub. Date: Dec. 1, 2005

(65) Prior Publication Data

US 2007/0181106 A1 Aug. 9, 2007

(30) Foreign Application Priority Data

May 21, 2004 (DE) ..... 10 2004 025 184

(51) Int. Cl.
*F02B 47/08* (2006.01)
*F02B 47/10* (2006.01)

(52) U.S. Cl. ..... 123/568.17; 123/568.11

(58) Field of Classification Search ..... 123/568.17, 123/568.18, 568.2, 568.12, 568.11
See application file for complete search history.

(56) References Cited

U.S. PATENT DOCUMENTS 6,347,620 B1 * 2/2002 Miyake ..... 123/568.29

(Continued)

FOREIGN PATENT DOCUMENTS

DE 31 09 285 A1 9/1982

(Continued)

OTHER PUBLICATIONS

PCT/ISA/220 and PCT/ISA/210, International Search Report issued in corresponding application No. PCT/EP2005/003802 completed Jul. 8, 2005 and mailed Aug. 2, 2005.

(Continued)

*Primary Examiner*—Mahmoud Gimie
(74) *Attorney, Agent, or Firm*—Griffin & Szipl, P.C.

(57) ABSTRACT

The invention relates to a controllable two-way valve (1), in which a valve rod (3) is connected in a permanent manner to at least two valve members (4, 5, 6, 24, 25; 39, 40), the valve rod (3) being actuated by means of an actuator (2). The housing (7) comprises an inlet (8; 4) or outlet and two corresponding outlets (9; 32; 42), (10; 28; 43) or inlets. According to the invention, the two valve members (4, 5, 6; 24, 25; 39, 40) correspond with at least two valve seats (12, 17, 22; 29, 37, 38; 46, 47) and the two or more valve members (4, 5, 6; 24, 25; 39, 40) have three control surfaces (11, 13, 18; 26, 27, 31; 44, 45, 48). The invention thus provides a dirt-resistant valve, which is easy to operate, has fixed valve members and does not require additional equipment. Said valve permits both the inlet to be completely blocked and the two outlets to be controlled independently of one another.

19 Claims, 5 Drawing Sheets

U.S. PATENT DOCUMENTS 7,011,081 B2 * 3/2006 Hrytzak et al. ..... 123/568.17

FOREIGN PATENT DOCUMENTS

| | | | |
|---|---|---|---|
| DE | 197 33 964 | A1 | 2/1999 |
| DE | 197 34 801 | A1 | 2/1999 |
| DE | 198 12 702 | A1 | 9/1999 |
| DE | 198 51 677 | | 3/2000 |
| DE | 199 51 591 | | 1/2001 |
| DE | 100 25 877 | A1 | 12/2001 |
| EP | 0 900 931 | A2 | 3/1999 |
| FR | 2.067.442 | | 8/1971 |

OTHER PUBLICATIONS

PCT/ISA/237 Written Opinion of the International Seaching Authority.

Office Action in corresponding German application No. 10 2004 025 184.3 dated Feb. 10, 2005.

* cited by examiner

CONTROLLABLE TWO WAY VALVE DEVICE

This is a National Phase Application in the United States of International Patent Application No. PCT/EP2005/003802 filed Apr. 12, 2005, which claims priority on German Patent Application No. DE 10 2004 025 184.3, filed May 21, 2004. The entire disclosures of the above patent applications are hereby incorporated by reference.

FIELD OF THE INVENTION

The invention relates to a controllable two-way valve device for an internal combustion engine, which device features a valve rod and at least two valve members and that can be actuated via an actuator, as well as with a housing in which one inlet or one outlet and two outlets or inlets are embodied, whereby each inlet or outlet can be connected fluidly to one or both of the outlets or inlets.

BACKGROUND OF THE INVENTION

Such controllable two-way valve devices are known in particular as combined exhaust gas recirculation- and bypass valve devices in which two valve members are actuated via an actuator in order to reduce the pollutant emissions of a combustion engine, in that in the warm-up period the exhaust gas is conducted via the bypass and after a catalyst has heated up, the exhaust gas is recirculated via the EGR cooler.

Thus in DE 100 25 877 an exhaust gas recirculation system is described with a valve device that features one exhaust gas inlet and two exhaust gas outlets, whereby one of the exhaust gas outlets leads to a cooler and the other exhaust gas outlet leads to a bypass channel bypassing the cooler. On a housing of the valve, a valve seat is arranged respectively between the exhaust gas inlet and the two exhaust gas outlets, which valve seat is governed by a disk-shaped valve member. A valve member is arranged thereby on an inner valve rod that can be moved via the actuator, and the second valve member arranged nearer to the actuator is arranged in a permanent manner on a second tubular valve rod bypassing the first valve rod. The actuator is embodied thereby such that two springs are arranged in the actuator via which the two valve disks are pressed onto their valve seats tensioned. The inner and the outer valve rod are each arranged so that they can be displaced with respect to one another, so that the pneumatic or electromotive actuator is embodied such that, depending on the direction of movement, only one of the valve rods and thus also only one of the valve members is lifted from the valve seat.

In DE 198 12 702 A1 a valve arrangement for the control of a recirculated exhaust gas stream is likewise described, whereby this is arranged behind a bypass channel or an exhaust gas cooler respectively, so this features two inlets and one outlet. The two valve members corresponding respectively to a valve seat are respectively pressed onto the valve seat via two coil springs arranged in the channel. Both valve members feature a hole in the center through which a common valve rod extends at least partially. The valve rod features two collars via which, when the valve rod is actuated, the valve members can be actuated respectively individually via the collar in the direction of opening against the spring force, whereby the respective other valve member is to slide on the valve rod, since it is pressed farther onto the valve seat by means of spring force.

DE 197 33 964 A1 describes a similar valve arrangement, whereby the tensioning of the two valve disks is achieved here via a spring arranged between the two valve disks, so that the two collars of the valve rod are respectively arranged at the end of the valve disks opposite the spring.

The disadvantage of the above-mentioned embodiments is that either two valve rods, and thus correspondingly complex actuators are required, for displacement of the valve rods independent of one another, or in the embodiment with a single valve rod, the valve members are not arranged in a permanent manner on the rod, and thus do not occupy a defined position in the housing. Moreover such a valve arrangement is very sensitive to dirt, because the coil springs are arranged in the area through which exhaust gas flows, and also in the area through which exhaust gas flows the valve rod extends through the valve holes and must be moved there. Deposits can form on the valve rod due to carbon, so that a flawless function, namely a sliding of the valve rod in the holes of the valve members is no longer ensured. Moreover, in all embodiments only one of the two inlets or outlets can be opened, so that it is not possible for the exhaust gas to flow through the cooler and the bypass channel simultaneously, as a result of which mixed temperatures cannot be achieved. Due to exhaust gas pulsations occurring at the valve, the spring force for a reliable closure of the channels must be selected to be very high so that the actuator must also exert high forces during opening against the spring force, and thus must be embodied large and cost-intensive.

It is therefore an object of the invention to create a controllable two-way valve device controlled by a simple actuator, which device features only one valve rod and in which it is possible to control both outlet streams or inlet streams individually and independently of one another, and to interrupt an exhaust gas recirculation completely and reliably in spite of occurring gas pulsations. Moreover, the valve is to be as insensitive as possible to dirt and is to be cost-effective to produce and to assemble. In a preferred embodiment, it is also to be possible for partial streams to be conducted through the exhaust gas cooler or the bypass channel, respectively, so that mixed temperatures can be run.

BRIEF SUMMARY OF THE INVENTION

This object is achieved in that the valve rod is connected in a permanent manner to the at least two valve members that correspond with at least two valve seats, whereby the at least two valve members feature three control surfaces. Thus, a valve device is created in which the inlet or outlet channels can be respectively closed individually, whereby for this purpose only one valve rod, which is connected to an actuating device, is needed. In addition, no inner baffles or tensionings of the valve rod or of the valve members are necessary. A possible quantity control of the individual streams to the bypass channel or to the exhaust gas cooler is maintained. With an appropriate arrangement of the different valve members with respect to the valve seats, it is possible with such a device to achieve defined temperatures through a mixture of the exhaust gas stream that is conducted partly through the exhaust gas cooler and partly through the bypass channel.

Preferably, the controllable two-way valve device is a combined exhaust gas recirculation- and bypass valve device, whereby the inlet is connected fluidly to an exhaust gas recirculation channel, the first exhaust gas outlet is connected fluidly to an exhaust gas cooler directly or via a channel, and the second exhaust gas outlet is connected fluidly to a bypass channel via which the exhaust gas cooler can be bypassed.

Preferably at least one of the valve members features a control surface extending in the axial direction with respect to the valve rod, by means of which an exhaust gas mass flow control can be implemented simply and cost-effectively. Both outlet streams are to be controlled individually and independently of one another and an exhaust gas recirculation can be interrupted completely and reliably in spite of occurring gas pulsations, because no additionally affecting spring force at the valve member needs to be overcome.

In a further form of embodiment, the axially extending control surface is embodied as a cylindrical outer jacket whose central axis is formed by the valve rod. This ensures that it is simple to produce and assembly.

In a preferred form of embodiment, three valve members are arranged on the valve rod, which valve members interact with one valve seat respectively, whereby a first valve member governs the exhaust gas inlet, a second valve member governs the outlet to the exhaust gas cooler that is arranged between the exhaust gas inlet and the outlet to the bypass channel and features the axially extending control surface, whereby the second valve member can be flowed through in the axial direction, and a third valve member governs the outlet to the bypass channel. Such an arrangement is suitable in different positions of the valve rod to completely block the exhaust gas stream as well as to block only the fluid connection to the cooler or to the bypass, as well as to conduct the exhaust gas both to the cooler and to the bypass, as a result of which a temperature control would be possible. Depending on the height of the axial control surface, a quantity control to the bypass channel is also possible when the cooling channel is closed.

In an alternative form of embodiment, two valve members are arranged on the valve rod, of which a first valve member features one axially extending control surface and one radially extending control surface, whereby each control surface corresponds with a valve seat. In comparison with the alternative embodiment, one valve member can be omitted and a control of the exhaust gas mass flows to the bypass or to the cooler is implemented by two valve members connected in a permanent manner to the valve rod.

In a form of embodiment leading on from this, the radially extending control surface of the first valve member governs the exhaust gas inlet, the axially extending control surface of the first valve member governs the outlet to the bypass channel, and a radially extending control surface of the second valve member governs the exhaust gas outlet to the exhaust gas cooler, as a result of which a simple arrangement is provided that features a low space requirement through the arrangement of the different inlets and outlets and of the valve members. A control of the exhaust gas quantities recirculated to the cooler and to the bypass can be implemented by such an arrangement.

Additionally the second valve member can feature an axially extending jacket surface. This serves to seal the exhaust gas stream better from the cooler.

In a further form of embodiment the axially extending control surface of the first valve member is embodied as a cylindrical outer jacket whose diameter is smaller than the diameter of the second valve member and a gap is embodied between an inner wall of the housing and the cylindrical outer jacket, which gap is arranged on the side facing away from the first outlet. By these means the fluid connection to the exhaust gas cooler is enabled at the inlet when the control surface is opened, and a secure function of the device is a small space is realized, whereby the assembly and production of the individual parts, and in particular, also of the housing of the valve is to be carried out in a cost-effective manner.

In an alternative form of embodiment, the exhaust gas inlet is arranged between the exhaust gas outlets, as a result of which an exhaust gas mass flow control to the bypass and to the cooler is possible when the other outlet to the bypass or cooler respectively is closed, and only two valve seats need to be governed and embodied.

In a form of embodiment leading on from this, the distance between two radially extending control surfaces of the first and of the second valve member is equal to the height of the exhaust gas inlet between a first and second valve seat, of which the first valve seat encloses the passage between the exhaust gas inlet and the exhaust gas outlet to the bypass channel and the second valve seat encloses the passage between the exhaust gas inlet and the exhaust gas outlet to the exhaust gas cooler. By these means a complete and secure closure is ensured through the placements of the radially extending control surfaces when the exhaust gas recirculation is switched off.

In a form of embodiment again leading on from this, the exhaust gas inlet stream is interrupted by means of the resting of the radially extending control surfaces on the valve seats, and the axially extending control surface of the first valve member features the same outer diameter as the inner diameter of the two valve seats and features a height that essentially corresponds to the distance between the two valve seats, so that optionally the axially extending control surface interacts with one of the two valve seats, respectively. Thus, here too an exhaust gas quantities flow control is possible with a closed second outlet. At the same time, this valve is insensitive to dirt, and requires low actuating forces, so that a small and cost-effective actuator can be selected.

It is thus possible for a two-way valve, with only one actuating device and one valve rod on which at least two valve members arranged in a permanent manner are present, to control exhaust gas quantities flows both to the cooler and also to a bypass channel independently of one another, whereby the highest possible insensitivity to dirt is provided and a cost-effective producibility and assembly is possible. Even when pulsations of the exhaust gas occur, the actuator only requires low actuating forces, so that cost-effective drives can be used and the space requirement is reduced.

Three exemplary embodiments of a two-way valve device, according to the invention, are shown in the drawings using an exhaust gas recirculation- and bypass valve device as an example and are described below.

DETAILED DESCRIPTION OF THE INVENTION

In the description of the different forms of embodiment, the same reference numbers are used to designate parts fulfilling the same functions.

Figure 1:
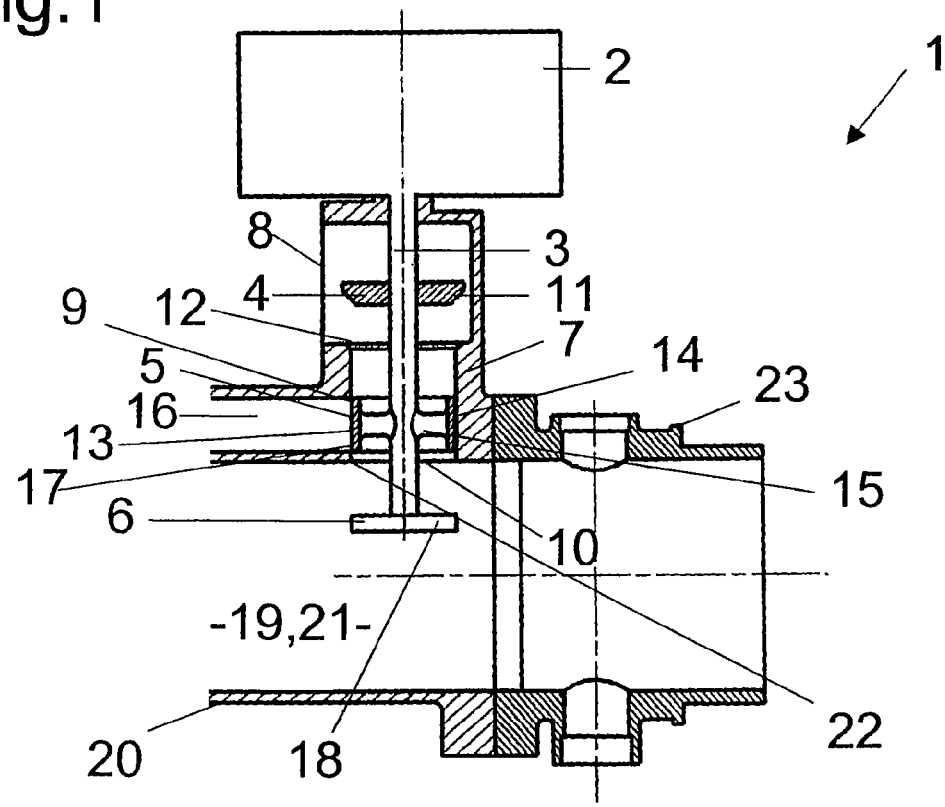
FIG. 1 shows a two-way valve device according to the invention in side view and sectional representation with three valve members.

The combined exhaust gas recirculation- and bypass valve device 1 shown in FIG. 1 is composed of an actuator 2, via which a valve rod 3 can be set in motion translationally. The actuator 2 must thereby be embodied preferably as an electromotive drive active in both directions and having a position sensor. On the valve rod 3, three valve members 4, 5, 6 are arranged in a permanent manner, which valve members interact with exhaust gas inlets or outlets 8, 9, 10 embodied in a housing 7 of the exhaust gas recirculation- and bypass valve device 1, whereby precisely one exhaust gas inlet or outlet 8, 9, 10 is assigned to each valve member 4, 5, 6. A control surface 11 of the first valve member 4 interacts with a valve seat 12 that is arranged at the end of the exhaust gas inlet 8, so that when the valve member 4 is seated on the valve seat 12, a recirculated exhaust gas stream is interrupted. For this purpose the exhaust gas inlet 8 is connected in a known manner to an exhaust gas recirculation channel, not shown.

The second valve member 5 features a control surface 13 extending axially with respect to the valve rod, which control surface is arranged on a cylindrical outer jacket 14 that is connected to the valve rod 3 via bridges 15, so that this valve member 5 can be flowed through in the axial direction. This valve member 5 through its axially extending control surface 13 governs a channel 16 that is connected to an exhaust gas cooler, not shown. For this purpose the housing 7 features a second valve seat 17 that corresponds with the axially extending control surface 13 of the valve member 5. The valve member 6 farthest away from the actuator 2 is embodied as a disk valve and via a radially extending control surface 18 governs a second exhaust gas outlet 10 that in the present exemplary embodiment leads directly into a collecting channel 19 of an intake pipe 20 and serves as a bypass channel 21 for bypassing the exhaust gas cooler. Of course, it is likewise conceivable to embody a separate bypass channel 21 that is governed by the valve member 6. To close this bypass channel 21, the valve member 6 corresponds with a valve seat 22 that is likewise embodied on the housing 7 of the exhaust gas recirculation- and bypass valve device 1. In the present exemplary embodiment, the exhaust gas introduction takes place immediately behind a throttle valve connection 23.

In the position of the valve device 1 and thus of the valve members 4, 5, 6 in the position shown in FIG. 1, a fluid connection is produced between the exhaust gas recirculation channel, that is, the exhaust gas inlet 8 and the intake pipe 20 serving as bypass channel 21, while the valve member 5 closes the channel 16 to the exhaust gas cooler. Such a position of the valve 1 is customary for example when a combustion engine is started, in order to heat the catalyst faster. If the valve rod 3 is now moved further downwards, the control surface 13 of the cylindrical outer jacket 14 of the valve member 5 pushes away from the valve seat 17, so that the channel 16 to the exhaust gas cooler is connected fluidly to the exhaust gas inlet 8. In such a position a temperature control would accordingly be possible, since with a further-enlarging opening of the outlet 9, the exhaust gas stream to the cooler will also increase proportional to the surface that is being flowed through. With a further displacement of the valve rod 3 in the direction of the intake pipe, the valve member 4 places itself on the valve seat 12, so that the exhaust gas recirculation is interrupted.

Again, starting from the position shown in FIG. 1, the valve rod 3 can also be moved in the direction of the actuating device 2, so that again the exhaust gas outlet 9 is opened and a temperature control over a certain range is possible, since the cross-sections of the valve seats 17, 22 that are being flowed through are enlarged or reduced dependent on one another. In an end position of this movement, the exhaust gas outlet 9 is completely opened and the valve member 6 sits on the valve seat 22, so that the entire recirculated exhaust gas stream is now conducted to the combustion engine via the cooler, which is desired in particular in the middle load ranges of a combustion engine when the internal combustion engine is already warmed up.

Thus by means of such a two-way valve, the exhaust gas recirculation can be completely closed and also optionally the exhaust gas is conducted either completely via the bypass pipe or the intake pipe or is conducted completely via the exhaust gas cooler. A mixed operation is also possible, whereby in the mixed operation the quantity of exhaust gas conducted to the cooler increases or decreases when the valve rod 3 is moved in the same ratio as the quantity conducted via the bypass channel 21 decreases or increases. By enlarging the axial extension of the axial control surface 13 in comparison with FIG. 1 in the direction of the actuating device, a quantity control is also possible via the bypass channel 21 when the cooling channel 16 is closed.

Figure 2:
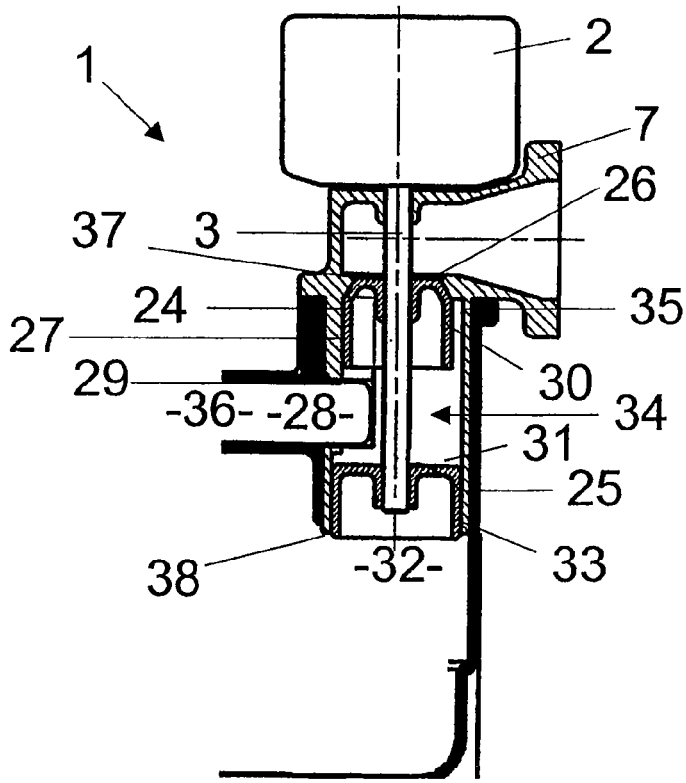
FIG. 2 shows a second two-way valve device according to the invention with two valve members likewise in a sectional schematic representation.

The two-way valve shown in FIG. 2, which is also embodied here as an exhaust gas recirculation- and bypass valve device 1, features on its valve rod 3 only two valve members 24 and 25, whereby the valve member 24 arranged closer to the actuating device 2 combines the functions of the valve members 4 and 5 from FIG. 1. This valve member 24 features both a radially extending control surface 26 and an axially extending control surface 27, which governs a first exhaust gas outlet 28 and that essentially interacts with a valve seat 29 like the control surface 12 in FIG. 1 and is part of a cylindrical outer jacket 30. The valve member 25 also features a radially extending control surface 31 that governs a second exhaust gas outlet 32. This valve member 25 features in addition a cylindrical outer jacket 33 that however is primarily present for improved sealing against a corresponding hole 34 in the housing 7, so that leakage streams are avoided. The two axially extending cylindrical outer jackets 30, 33 are thereby embodied intersecting or overlapping, that is, the cylindrical outer jacket 33 of the valve member 25 features a larger diameter than the cylindrical outer jacket 30 of the valve member 24. Whereas the cylindrical outer jacket 33 is completely adjacent to the inner walls of the housing 7, the cylindrical outer jacket 30 features a gap 35 between it and the inner wall of the housing 7, which gap is embodied at the side of the valve rod 3 opposite the outlet 28.

In the present exemplary embodiment, the exhaust gas outlet 28 is preferably connected to a bypass channel 36, while the exhaust gas outlet 32 leads to a cooler of the internal combustion engine. In the present position a valve seat 37 is completely closed by the valve member 24 or its radially extending control surface 26, so that no exhaust gas introduction takes place. If the valve rod 3 is now displaced downwards via the actuator 2, the radially extending control surface 26 detaches itself from the valve seat 37, so that an exhaust gas stream takes place to the bypass channel 36 via the gap 35. With a further displacement of the valve rod 3, the flowed-through cross-section through a valve seat 37 is enlarged, so that an increased exhaust gas stream to the bypass channel 36 takes place until the axially extending control surface 27 begins to close the bypass channel 36, in that it positions itself partly in front of the valve seat 29. With further movement, this takes place until the bypass channel 36 is completely closed.

Simultaneously with the complete closure of the outlet 28 and thus of the bypass channel 36, however, the exhaust gas outlet 32 that leads to the exhaust gas cooler opens, since the radially extending control surface 31 of the valve member 25 lifts itself completely from a radially extending valve seat 38, so that a flow-through cross-section becomes free and now the exhaust gas is conducted completely via the cooler, as is customary after the warm-up phase of the combustion engine.

Thus with such a valve device it is possible to control the recirculated exhaust gas quantity, both for a flow-through of the bypass channel 36 and for a flow-through of the exhaust gas cooler. A mixed operation is not possible in this present embodiment.

The controllable two-way valve shown schematically in FIG. 3, like the valve from FIG. 2, features two valve members 39 and 40. A decisive difference from the exhaust gas recirculation- and bypass valve devices 1 from FIGS. 1 and 2 here is that an inlet 41 is now arranged between two outlets 42 and 43. Based on four different positions of the valve 1 in the housing 7, as shown by FIGS. 3*a*), 3*b*), 3*c*) and 3*d*), the means by which the control takes place is evident.

Figure 3A:
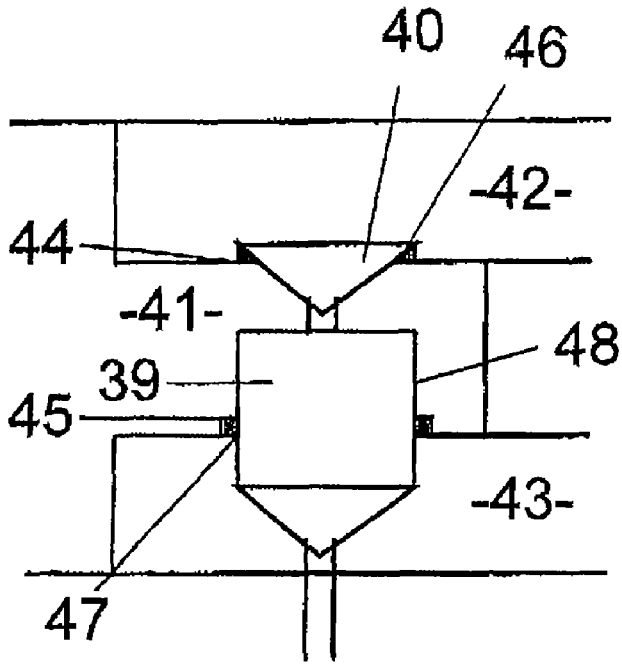
FIGS. 3*a*), 3*b*), 3*c*) and 3*d*) collectively illustrate, in schematic representation, a third form of an embodiment, in side view and schematic representation, whereby mode of operation is shown based on various positions of the valve, and these four figures are collectively referred to as "FIG. 3."

In FIG. 3*a*), the valve 1 is situated in a position closing the two exhaust gas outlets 42 and 43. This takes place in that both valve members 39, 40 feature radially extending control surfaces 44, 45 that rest on the valve seats 46, 47 corresponding to the outlets 42 and 43. The distance between these two radially extending control surfaces 44, 45 is accordingly equal to the height of the exhaust gas inlet 41.

Figure 3B:
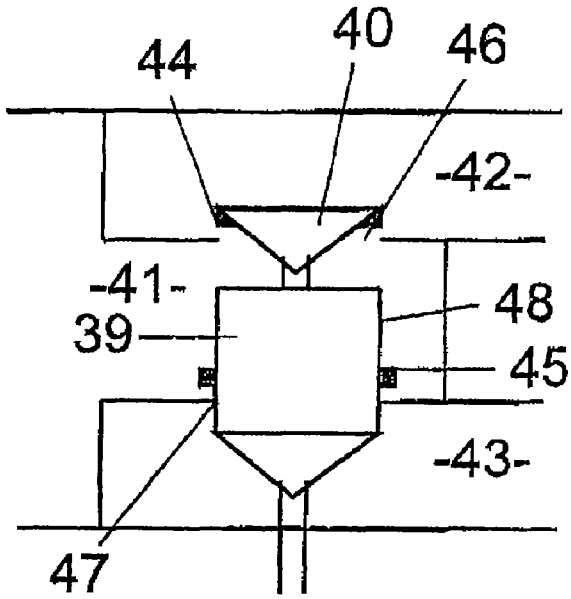

In FIG. 3*b*), a second position is shown in which now the two radially extending control surfaces 44, 45 are lifted from the valve seats 46, 47. By these means a flowed-through cross-section area is opened to the first exhaust gas outlet 42, while the valve seat 47 is now closed by an axially extending control surface 48 of the cylindrically embodied valve member 39, so that an exhaust gas flow to the exhaust gas outlet 43 is not possible. Through the slight lifting or dropping in this area, an exhaust gas stream only to the exhaust gas outlet 42 is thus controlled.

Figure 3C:
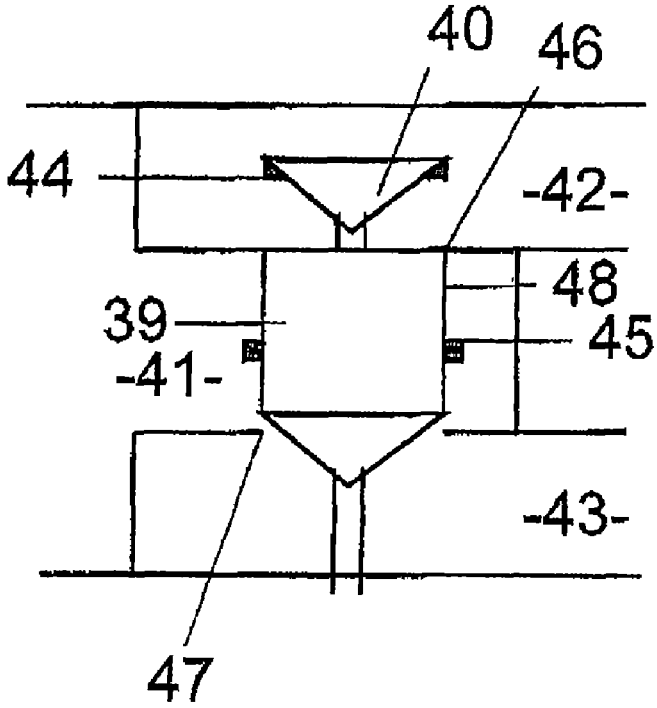

In comparison to this, FIG. 3*c*) shows a position in which the axially extending control surface 48 is now beginning to interact with the valve seat 46, that is, to close the passage to the first exhaust gas outlet 42. At the same time, however, the exhaust gas outlet 43 is opened, since the axially extending control surface 48 now lifts itself from the valve seat 47, so that now a smaller exhaust gas stream can flow to the exhaust gas outlet 43. Accordingly the height of the axially extending control surface 48 in this exemplary embodiment is to be selected such that it essentially corresponds to the height of the exhaust gas inlet 41. At the same time the diameter of the two valve seats 46 and 47 and of the axial control surface 48 is to be selected to be the same.

Figure 3D:
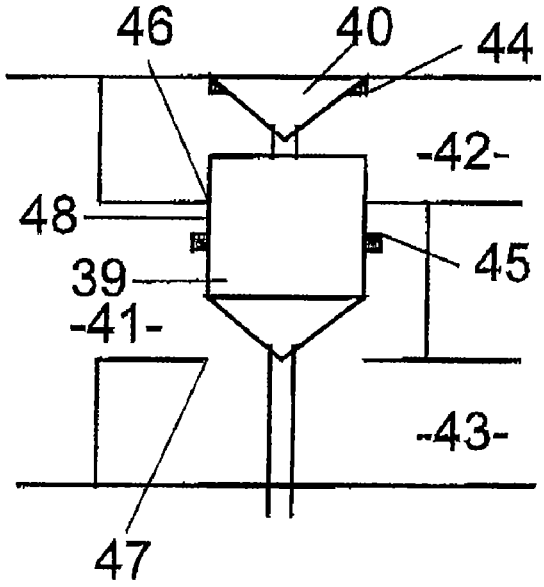

In FIG. 3*d*), the valve 1 is now situated in a position that is displaced further upwards, so that the entire flowed-through cross-section is opened to the exhaust gas outlet 43.

Thus the quantity of both exhaust gas streams can be controlled independently of one another. By matching the heights of the axial control surfaces, these valves can be matched respectively to corresponding requirements, so that mixed operations are also optionally possible.

By means of these forms of embodiment, dirt-insensitive two-way valve devices are created that do not need any additional inner baffles and can be produced simply and cost-effectively. They ensure both a switching-off and a control of both outlet quantities present with low required actuating forces.

It should be clear that various modifications of the construction of such valves are possible, whereby in particular the arrangement of the various inlets and outlets to one another and also the arrangement of the axial or radial control surfaces to one another can be changed. A use outside the field of exhaust gas recirculation is also conceivable, whereby it should be clear that an arrangement both before and after an exhaust gas- or bypass channel is possible.

The invention claimed is:

1. Controllable two-way valve device for an internal combustion engine, the device comprising:

a valve rod and at least two valve members that are actuatable via an actuator; and a housing in which one first inlet or one first outlet and two further outlets or further inlets are embodied, whereby the first inlet or first outlet is connectable fluidly to (a) one of the two further outlets or further inlets, or (b) both of the two further inlets or further outlets, wherein the valve rod is connected in a permanent manner to the at least two valve members that correspond with at least two valve seats, whereby the at least two valve members include three control surfaces.

2. Controllable two-way valve device for an internal combustion engine according to claim 1, wherein the controllable two-way valve device is a combined exhaust gas recirculation- and bypass valve device, whereby the first inlet is connectable fluidly to an exhaust gas recirculation channel, a first exhaust gas outlet is connectable fluidly to an exhaust gas cooler directly or via a second channel, and a second exhaust gas outlet is connectable fluidly to a bypass channel so that the exhaust gas cooler can be bypassed.

3. Controllable two-way valve device for an internal combustion engine according to claim 1, wherein at least one of the valve members includes a first control surface extending in an axial direction with respect to the valve rod.

4. Controllable two-way valve device for an internal combustion engine according to claim 3, wherein the axially extending first control surface is embodied as a cylindrical outer jacket whose central axis is formed by the valve rod.

5. Controllable two-way valve device for an internal combustion engine according to claim 1, wherein the device further comprises three valve members that are arranged on the valve rod and three valve seats, wherein each valve member interacts respectively with one valve seat, whereby a first valve member governs an exhaust gas inlet, a second valve member governs an outlet to an exhaust gas cooler that is arranged between the exhaust gas inlet and an outlet to a bypass channel; and an axially extending control surface, whereby the second valve member can be flowed through in the axial direction, and a third valve member governs the outlet to the bypass channel.

6. Controllable two-way valve device for an internal combustion engine according to claim 1, wherein two valve members are arranged on the valve rod, wherein the two valve members include a first valve member comprising one axially extending control surface and one radially extending control surface, whereby each control surface corresponds with a valve seat.

7. Controllable two-way valve device for an internal combustion engine according to claim 6, wherein the radially extending control surface of the first valve member governs an exhaust gas inlet, the axially extending control surface of the first valve member governs an outlet to a bypass channel, and a radially extending control surface of a second valve member of the two valve members governs an exhaust gas outlet to an exhaust gas cooler.

8. Controllable two-way valve device for an internal combustion engine according to claim 7, characterized in that the second valve member includes an axially extending jacket surface.

9. Controllable two-way valve device for an internal combustion engine according to claim 7, wherein the axially extending control surface of the first valve member is embodied as a cylindrical outer jacket whose diameter is smaller than the diameter of the second valve member and a gap is disposed between an inner wall of the housing and the cylindrical outer jacket, wherein the gap is arranged on a side facing away from the outlet to the bypass channel.

10. Controllable two-way valve device for an internal combustion engine according claim 1, wherein an exhaust gas inlet is arranged between two exhaust gas outlets.

11. Controllable two-way valve device for an internal combustion engine according to claim 10, wherein the at least two valve members include a first valve member and a second valve member and the at least two valve seats include a first valve seat and a second valve seat, and a distance between two radially extending control surfaces of the first valve member and of the second valve member is equal to a height of the exhaust gas inlet between the first valve seat and second valve seat, wherein the first valve seat encloses a first passage between the exhaust gas inlet and one of the two exhaust gas outlets to a bypass channel, and the second valve seat encloses a second passage between the exhaust gas inlet and the other one of the two exhaust gas outlets to the exhaust gas cooler.

12. Controllable two-way valve device for an internal combustion engine according to claim 11, wherein an exhaust gas inlet stream is interrupted by resting the two radially extending control surfaces on the first valve seat and second valve seat, and an axially extending control surface of the first valve member comprises the same outer diameter as an inner diameter of the two valve seats and a height that essentially corresponds to the distance between the two valve seats so that, optionally, the axially extending control surface of the first valve member interacts with one of the two valve seats.

13. Controllable two-way valve device for an internal combustion engine according to claim 2, wherein at least one of the valve members includes a first control surface extending in an axial direction with respect to the valve rod.

14. Controllable two-way valve device for an internal combustion engine according to claim 2, wherein two valve members are arranged on the valve rod, wherein the two valve members include a first valve member comprising one axially extending control surface and one radially extending control surface, whereby each control surface corresponds with a valve seat.

15. Controllable two-way valve device for an internal combustion engine according to claim 3, wherein two valve members are arranged on the valve rod, wherein the two valve members include a first valve member comprising one axially extending control surface and one radially extending control surface, whereby each control surface corresponds with a valve seat.

16. Controllable two-way valve device for an internal combustion engine according to claim 4, wherein two valve members are arranged on the valve rod, wherein the two valve members include a first valve member comprising one axially extending control surface and one radially extending control surface, whereby each control surface corresponds with a valve seat.

17. Controllable two-way valve device for an internal combustion engine according claim 6, wherein an exhaust gas inlet is arranged between two exhaust gas outlets.

18. A controllable two-way valve device for an internal combustion engine, the device comprising:

a valve rod and at least two valve members that are actuatable via an actuator; and a housing in which one first inlet or one first outlet and two further outlets or further inlets are embodied, whereby the first inlet or first outlet is connectable fluidly to one or both of the two further outlets or further inlets, wherein the valve rod is connected in a permanent manner to the at least two valve members that correspond with at least two valve seats, whereby the at least two valve members include three control surfaces, and wherein the controllable two-way valve device is a combined exhaust gas recirculation- and bypass valve device, whereby the first inlet is connectable fluidly to an exhaust gas recirculation channel, a first exhaust gas outlet is connectable fluidly to an exhaust gas cooler directly or via a second channel, and a second exhaust gas outlet is connectable fluidly to a bypass channel so that the exhaust gas cooler can be bypassed.

19. A controllable two-way valve device for an internal combustion engine, the device comprising:

a valve rod and at least two valve members that are actuatable via an actuator;

a housing in which one first inlet or one first outlet and two further outlets or further inlets are embodied, whereby the first inlet or first outlet is connectable fluidly to one or both of the two further outlets or further inlets, wherein the valve rod is connected in a permanent manner to the at least two valve members that correspond with at least two valve seats, whereby the at least two valve members include three control surfaces;

three valve members that are arranged on the valve rod and three valve seats, wherein each valve member interacts respectively with one valve seat, whereby a first valve member governs an exhaust gas inlet, a second valve member governs an outlet to an exhaust gas cooler that is arranged between the exhaust gas inlet and an outlet to a bypass channel; and an axially extending control surface, whereby the second valve member can be flowed through in the axial direction, and a third valve member governs the outlet to the bypass channel.

* * * * *